US009874074B2

(12) United States Patent
Soltani

(10) Patent No.: US 9,874,074 B2
(45) Date of Patent: Jan. 23, 2018

(54) WATER TIGHT AND GAS TIGHT FLEXIBLE FLUID COMPENSATION BELLOW

(71) Applicant: BAKER HUGHES INCORPORATED, Houston, TX (US)

(72) Inventor: Mochtar Soltani, Lower Saxony (DE)

(73) Assignee: Baker Hughes, a GE company, LLC, Houston, TX (US)

( * ) Notice: Subject to any disclaimer, the term of this patent is extended or adjusted under 35 U.S.C. 154(b) by 864 days.

(21) Appl. No.: 14/056,508

(22) Filed: Oct. 17, 2013

(65) Prior Publication Data

US 2015/0107854 A1 Apr. 23, 2015

(51) Int. Cl.
*E21B 41/00* (2006.01)
*F17D 1/00* (2006.01)
*E21B 7/04* (2006.01)

(52) U.S. Cl.
CPC ..... *E21B 41/00* (2013.01); *E21B 7/04* (2013.01); *F17D 1/00* (2013.01); *Y10T 137/7025* (2015.04)

(58) Field of Classification Search
CPC ..... E21B 41/00; E21B 2033/55; E21B 7/04; E21B 33/127; F17D 1/00; Y10T 137/7025
See application file for complete search history.

(56) References Cited

U.S. PATENT DOCUMENTS 3,051,515 A * 8/1962 Graves ..... F16L 51/035 285/228
3,765,446 A * 10/1973 Livingston ..... A62C 37/08 137/504
4,015,633 A * 4/1977 Mandell ..... F16J 15/52 138/109
4,199,856 A * 4/1980 Farrow ..... E21B 10/24 141/1
4,265,305 A * 5/1981 Stone ..... E21B 17/028 166/113
4,335,791 A * 6/1982 Evans ..... E21B 10/24 175/228
4,593,774 A * 6/1986 Lingafelter ..... E21B 4/003 175/107
4,940,911 A * 7/1990 Wilson ..... H02K 5/132 310/87
5,072,795 A * 12/1991 Delgado ..... E21B 10/24 175/228
5,758,731 A * 6/1998 Zollinger ..... E21B 4/18 175/51
6,100,616 A * 8/2000 Heinig ..... E21B 41/00 310/112
6,811,842 B1 * 11/2004 Ehrnsperger ..... A61F 13/537 210/321.6
7,665,484 B2 * 2/2010 Kamada ..... F02M 37/0041 138/30
2007/0074872 A1 * 4/2007 Du ..... E21B 4/003 166/369

(Continued)

FOREIGN PATENT DOCUMENTS

EP 0494594 B1 10/1995

*Primary Examiner* — Brad Harcourt
(74) *Attorney, Agent, or Firm* — Mossman, Kumar & Tyler, PC

(57) ABSTRACT

An apparatus for protecting a functional fluid includes an inner pliant shell disposed inside an outer pliant shell. A sealed space separates the inner and outer pliant shells and the inner pliant shell defines a variable volume for receiving the functional fluid. A filler fills the sealed space.

13 Claims, 3 Drawing Sheets

(56) References Cited

U.S. PATENT DOCUMENTS

| | | | | |
|---|---|---|---|---|
| 2011/0048136 | A1* | 3/2011 | Birch | E21B 47/06 73/705 |
| 2011/0079140 | A1* | 4/2011 | Baseley | F15B 1/26 92/90 |

* cited by examiner

WATER TIGHT AND GAS TIGHT FLEXIBLE FLUID COMPENSATION BELLOW

BACKGROUND OF THE DISCLOSURE

1. Field of the Disclosure

This disclosure relates generally to oilfield downhole tools and more particularly to drilling assemblies utilized for directionally drilling wellbores.

2. Description of the Related Art

A number of tools and instruments are used during the construction, completion, and reworking of hydrocarbon producing wells. Some of these tools use some form of enclosure to prevent an environmental medium from coming into contact with a function fluid or a component. For instance, some tools use a circulating functional fluid, such as clean hydraulic fluid. This functional fluid is sometimes temporarily stored in an enclosure that is fluid tight. Also, one or more components may be disposed inside a enclosure that shields or protects sensitive electronics. Some of these enclosures have walls formed of a pliant material that stretches as a functional fluid enters the enclosure. For such applications, the material making up the walls should be flexible and fluid-tight against environmental medium (e.g., water or gas) at the same time. However, increasing the fluid-tightness of the material by increasing the material thickness or with special coating reduces the flexibility of the wall.

The present disclosure addresses the need for an enclosure that has exceptional fluid tightness while still being flexible.

SUMMARY OF THE DISCLOSURE

In aspects, the present disclosure provides an apparatus for protecting a functional fluid. The apparatus includes an inner pliant shell disposed inside an outer pliant shell. A sealed space separates the inner and outer pliant shells and the inner pliant shell defines a variable volume for receiving the functional fluid. A filler fills the sealed space.

In aspects, the present disclosure includes a method for protecting a functional fluid used in a wellbore in which an environmental media resides. The method includes forming an enclosure having an inner pliant shell disposed inside an outer pliant shell, wherein a sealed space separates the inner and outer pliant shells; at least partially filling the sealed space with a filler; positioning the enclosure along a conveyance device conveyed into the wellbore; and at least partially filling the variable volume with the functional fluid.

Examples of certain features of the disclosure have been summarized in order that the detailed description thereof that follows may be better understood and in order that the contributions they represent to the art may be appreciated. There are, of course, additional features of the disclosure that will be described hereinafter and which will form the subject of the claims appended hereto.

BRIEF DESCRIPTION OF THE DRAWINGS

For detailed understanding of the present disclosure, references should be made to the following detailed description of the preferred embodiment, taken in conjunction with the accompanying drawings, in which like elements have been given like numerals and wherein.

DETAILED DESCRIPTION OF THE DISCLOSURE

As will be appreciated from the discussion below, aspects of the present disclosure provide enclosures for protecting functional fluids. In embodiments, the enclosure may use a multi-shell bellows arrangement that incorporates a filler material. The filler material, or simply 'filler,' may be barrier fluid can hinder invasion by the environmental medium and/or capture and store an invading environmental medium. Embodiments of the present disclosure may be used with any number of fluid systems in various industries. Merely for brevity, the present teachings will be discussed in connection with devices and tools used in subsurface applications.

Figure 1:
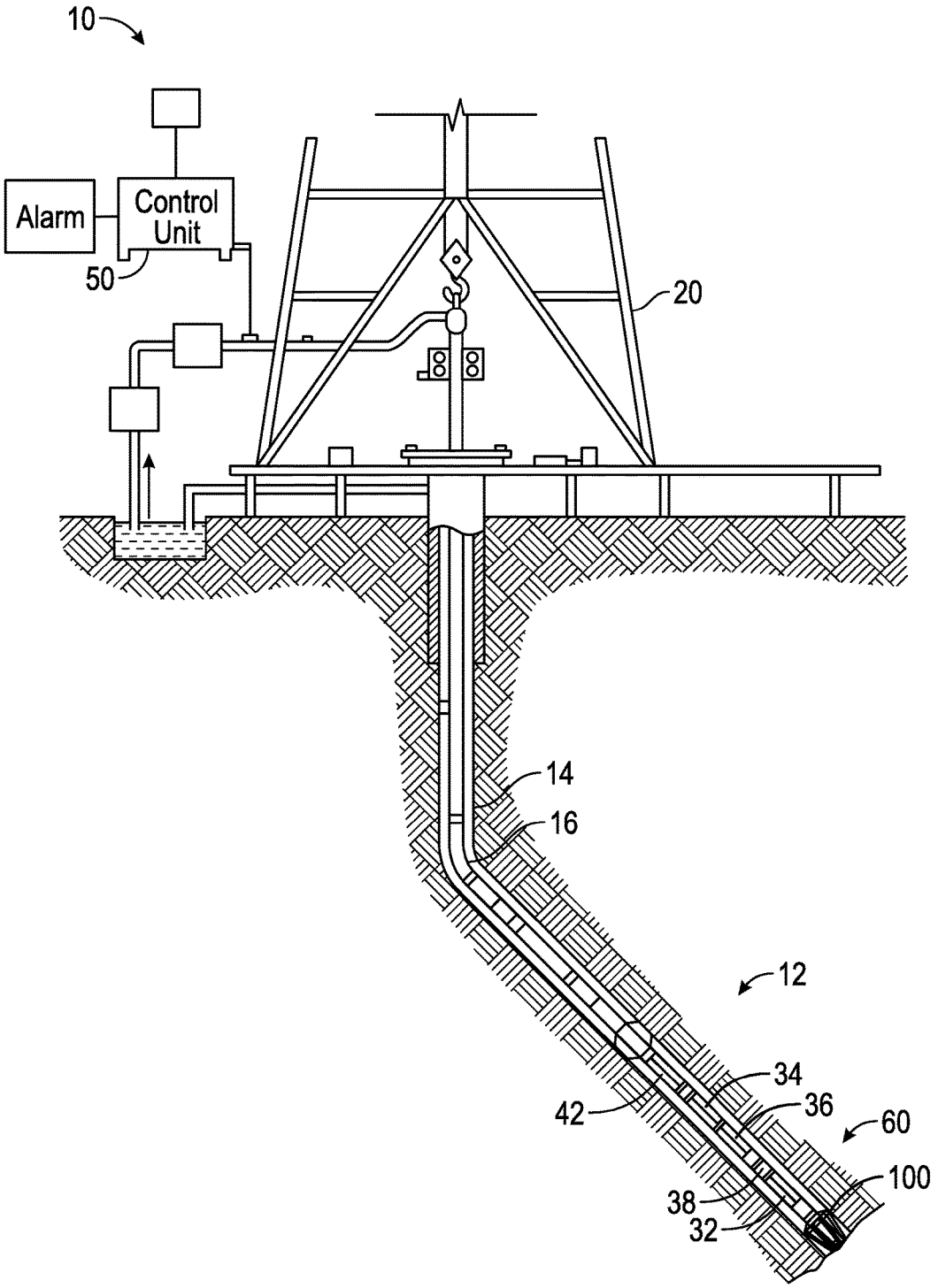
FIG. 1 illustrates a downhole system that may use enclosures made in accordance with embodiments of the present disclosure.

Referring now to FIG. 1, there is shown one illustrative embodiment of a drilling system 10 utilizing a steerable drilling assembly or bottomhole assembly (BHA) 12 for directionally drilling a wellbore 14. While a land-based rig is shown, these concepts and the methods are equally applicable to offshore drilling systems. The system 10 may include a drill string 16 suspended from a rig 20. In another embodiment, the drill may be connected to a rotary table (not shown) for use in rotating the drilling string. This rotary table apparatus is widely known by one of ordinary skill in the art. The drill string 16, which may be jointed tubulars or coiled tubing, may include power and/or data conductors such as wires for providing bidirectional communication and power transmission. The drill string 16 is only one embodiment of a "conveyance device" that may be used in connection with the present disclosure. In one configuration, the BHA 12 includes a steerable assembly 60 that includes a drill bit 100, a sensor sub 32, a bidirectional communication and power module (BCPM) 34, a formation evaluation (FE) sub 36, and rotary power devices such as drilling motors 38. The formation evaluation sub 36 may include devices for obtaining information regarding the formation and resident fluids, such as fluid sampling tools and coring tools. It should be understood that these devices are only illustrative, and not exhaustive, of the "well tools" that may be used in a wellbore. For brevity, all such devices will be referred to as "well tools." The system may also include information processing devices such as a surface controller 50 and/or a downhole controller 42.

The wellbore 14 is usually filled with an environmental medium that can damage components of the BHA 12 and contaminate the functional fluids used by these components. Typical environmental mediums include, but are not limited to, formation fluids, drilling mud, and surface supplied fluids. Discussed below are embodiments of enclosures that may be used to protect sensitive components associated with well tools and prevent contamination of functional fluids that are used by well tools.

Figure 2:
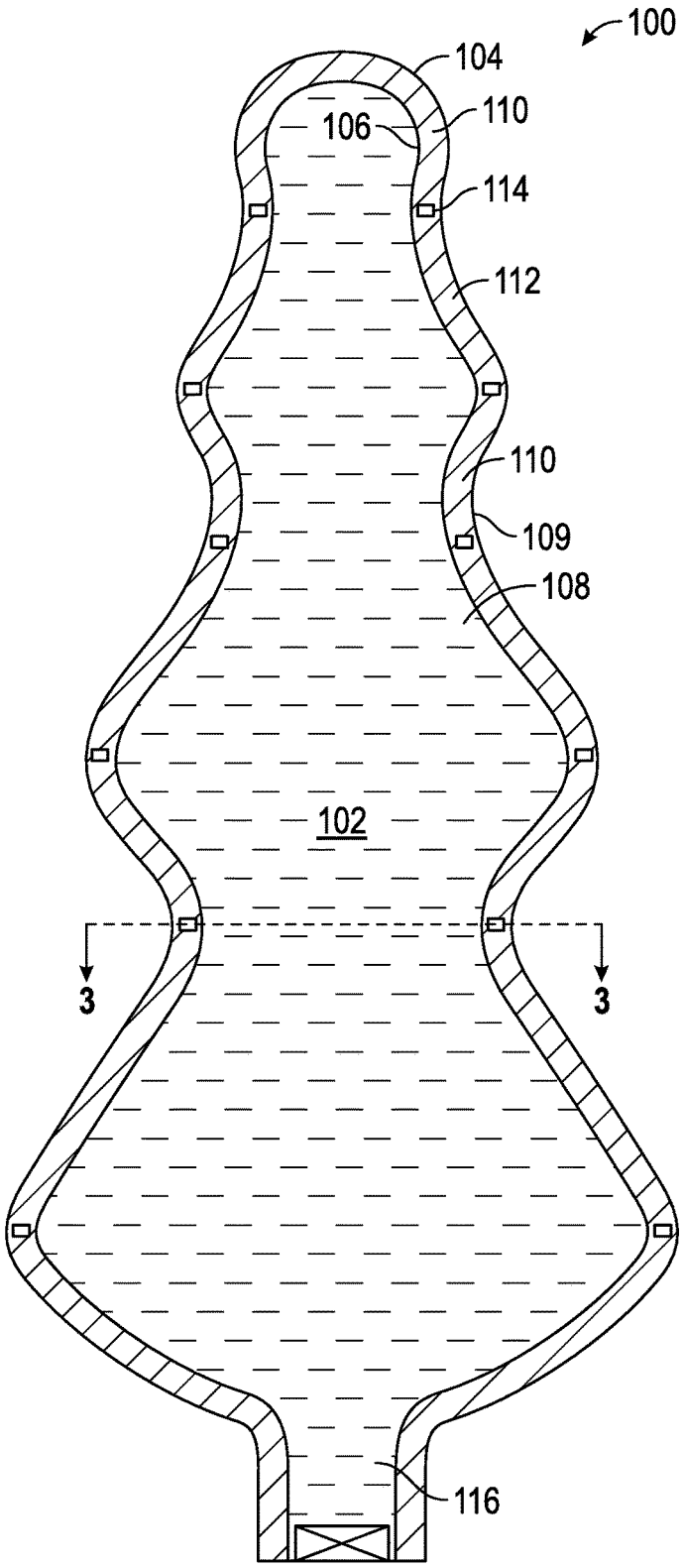
FIG. 2 illustrates a bellows-like protective enclosure made in accordance with one embodiment of the present disclosure.

Referring now to FIG. 2, there is shown one embodiment of an enclosure 100 that may be used to store a functional fluid 102. The functional fluid may be a flowing fluid; e.g., hydraulic fluid, oil, grease, gel, or a gas (e.g., air, nitrogen, an inert gas, etc.). The enclosure 100 may include a plurality of nested shells that is both fluid tight (i.e., a liquid tight and gas tight) and flexible. While any number of shells may be used, the FIG. 2 embodiment uses two shells: an outer shell 104 and an inner shell 106. The shells 104, 106 may be an impermeable membrane formed of any natural or synthetic material that is pliable (i.e., a material that can elastically deform such as an elastomer or rubber). The shells 104, 106 may have a balloon like shape and have a chamber 108 for receiving the functional fluid 102. The chamber 108 may have a variable volume. That is, the chamber 108 may expand and contract between a minimal working volume and a maximum working volume. The shells 104, 106 may include folds or pleats 109 that allow expansion and contraction.

The outer shell 104 and the inner shell 106 are dimensioned to form a space or gap 110. The gap 110 separates the inner surface of the outer shell 104 from the outer surface of the inner shell 106. The gap 110 may be a sealed space. A filler 112 at least partially fills and is sealed within the gap 110. Also, a centralizer 114 may be used to maintain the size or width of the gap 110. The functional fluid enters the chamber 108 of the enclosure 100 via a neck or inlet 116.

The filler 112 may be used to adjust the flexibility of the enclosure 100 and/or enhance the fluid tightness of the enclosure 100. The filler 112 may be a solid, a liquid, a gas, a gel, or a mixture thereof. In one embodiment, the filler 112 may include a sorbent material. The sorbent material may use either absorption or adsorption to entrap and store an environmental medium that has leaked past the outer shell 104. Illustrative, but not exclusive sorption materials include Superabsorbent Polymers (SAP) such as sodium polyacrylate, cellulose, zeolite, etc. The sorbent material may be premixed with a fluid such as water to provide flexibility. In other embodiments, the filler 112 may include grease, oil, gels etc. Additionally, to resist invasion by gas molecules, the filler 112 can be pressurized to a pressure higher pressure than atmospheric pressure. The actual pressure value may be selected to provide the desired amount of flexibility of the enclosure. Further, the viscosity of a fluid and amount of entrained materials may be adjusted to obtain the desired flexibility.

Figure 3:
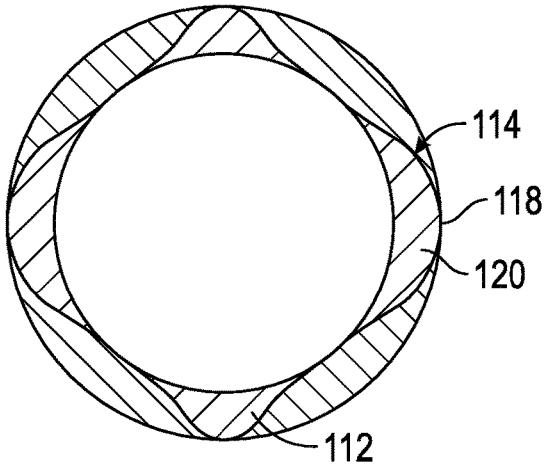
FIG. 3 illustrates a centralizer for use with the FIG. 2 embodiment.

Referring to FIG. 3, there is shown one embodiment of a centralizer 114 made in accordance with the present disclosure. The centralizer 114 has a ring-shaped body 118 that includes passages 120 through which the filler 112 may flow along the gap 110 (FIG. 2).

One method of use may involve the enclosure 100 functioning as an oil compensator for a hydraulic unit. Referring now to FIGS. 2 and 3, a hydraulic source (not shown) may pump the functional fluid 102 into the chamber 108 via the inlet 116. The shells 104, 106 expand to accommodate the influx of the functional fluid 102. At some point, the hydraulic source (not shown) may draw the functional fluid 102 out of the chamber 108. The elastic properties of the shells 104, 106 allow the enclosure 100 to shrink in size as the functional fluid 102 exits the chamber 108. It should be appreciated that the presence of the filler 112 allows the shells 104, 106 to expand and contract (shrink) with relatively less applied pressure. Further, the filler 112 may absorb environmental media that leaks into the gap 110. Still further, if the filler 112 is pressurized, then the pressure may resist the diffusion or movement of gas molecules from the environmental media into the chamber 108. It should be noted that the use of the filler 112 enhances protection of the functional fluid 102 without reducing the flexibility of the shells 104, 106.

Figure 4:
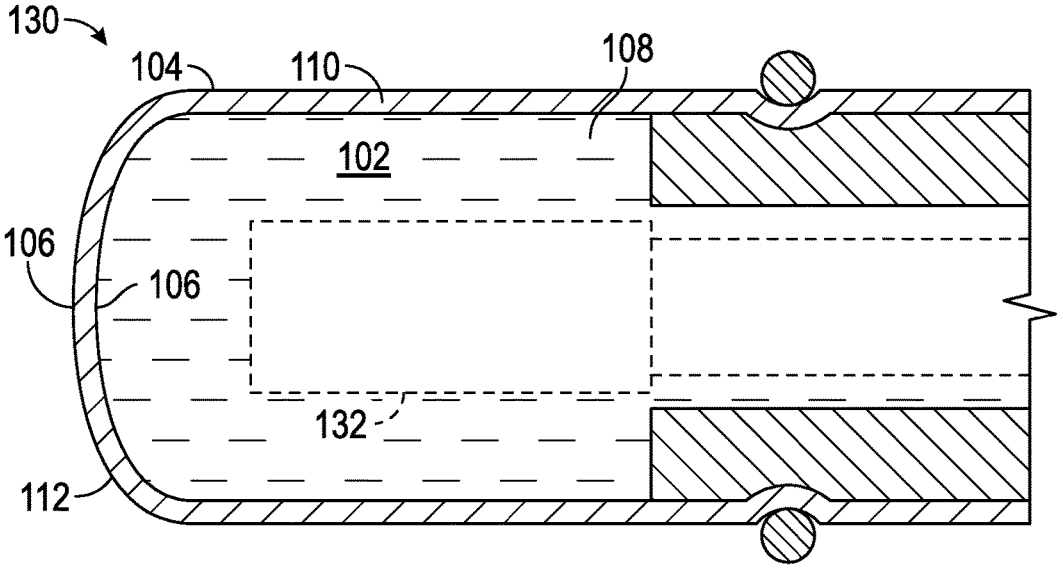
FIG. 4 illustrates a tank-like enclosure made in accordance with one embodiment of the present disclosure.

Referring now to FIG. 4, there is shown an enclosure 130 according to the present disclosure that may be used to protect a selected component 132. The component 132 may be a sensitive mechanical component, a electronic component or other device that may be damaged if exposed to an environmental medium. Similar to the FIG. 2 embodiment, the enclosure may include two or more shells: an outer shell 104 and an inner shell 106 formed of an impermeable membrane. The shells 104, 106 form a chamber 108 for receiving the component 132 and a functional fluid may fill the chamber 108. A gap 110 separates the inner surface of the outer shell 104 from the outer surface of the inner shell 106 and a filler 112 at least partially fills the gap 110. These features are similar to those already discussed. In this embodiment, the shells 104, 106 do not include pleats or folds.

Figure 5:
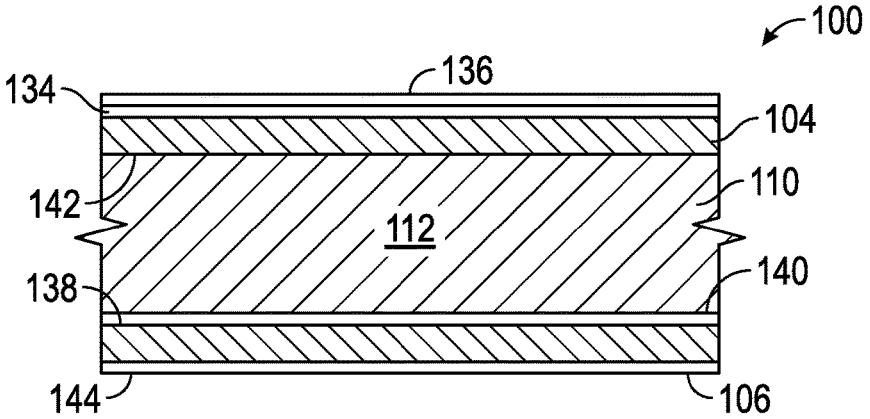
FIG. 5 illustrates linings that may be used in connection with an enclosure made in accordance with one embodiment of the present disclosure.

However, the FIG. 4 embodiment may include one or more surface treatments for inhibiting invasion of the environmental media. The surface treatments are best seen in FIG. 5, which shows a sectional view of a portion of the enclosure 100. The enclosure 100 has the outer shell 104, the inner shell 106, and the filler 112 as previously described. In one arrangement, an outer surface 134 of the outer shell 104 includes a lining 136 and an outer surface 138 of the inner shell 106 include a lining 140. The linings 136, 140 may be made of the same material(s) or different material(s). The linings 136, 140 may be a liner that is slipped over the shells 104, 106, a coating that is deposited on the surfaces 134, 138 (e.g., by spraying), or may be some form of surface treatment. It should be understood that the location and number of linings 136, 140 are merely illustrative. For example, a lining may be used on the inner surface 142 of the outer shell 104 and/or the inner surface 144 of the inner shell 106. The linings 136, 140 may be used to adjust a desired parameter such as sealing effectiveness or flexibility. For example, the lining 136 may be a lining impermeable to gas to inhibit the penetration of gas into the gap 110.

It should be understood that the FIG. 2 and FIG. 4 embodiments are not mutually exclusive and the features shown in one embodiment may be used in the other embodiment. Further, the hydraulic source using the function fluid may be any device used in a wellbore: a drilling motor, an actuator for controlling a steering device, a hydraulic motor for a coring tool, a motor for operating a hole enlargement device such as a reamer, etc.

The term "conveyance device" as used herein means any device, device component, combination of devices, media and/or member that may be used to convey, house, support or otherwise facilitate the use of another device, device component, combination of devices, media and/or member. Exemplary non-limiting carriers include drill strings of the coiled tube type, of the jointed pipe type and any combination or portion thereof. Other carrier examples include casing pipes, wirelines, wire line sondes, slickline sondes, drop shots, downhole subs, BHA's, drill string inserts, modules, internal housings and substrate portions thereof.

While the foregoing disclosure is directed to the one mode embodiments of the disclosure, various modifications will be apparent to those skilled in the art. It is intended that all variations within the scope of the appended claims be embraced by the foregoing disclosure.

What is claimed is:

1. An apparatus for protecting a functional fluid, comprising:

an outer pliant shell;

an inner pliant shell disposed inside the outer pliant shell, wherein a sealed space separates the inner and outer pliant shells, and wherein the inner pliant shell defines a variable volume for receiving the functional fluid; and a filler filling the sealed space, the filler including a sorbent mixed with a liquid, the sorbent being configured to store a foreign fluid.

2. The apparatus of claim 1, further comprising at least one spacer disposed in the space and separating the inner and the outer pliant shells, the at least one spacer having at least one passage along which the filler flows.

3. The apparatus of claim 1, wherein the liquid is one of: (i) a hydrocarbon liquid, (ii) a gel, (iii) a grease.

4. The apparatus of claim 1, wherein the liquid is pressurized to at least a value greater than atmospheric pressure.

5. The apparatus of claim 1, further comprising a gas inhibiting lining applied to at least one of the outer pliant shell and the inner pliant shell.

6. The apparatus of claim 1, further comprising a hydraulic source configured to circulate the functional fluid into and out of the variable volume.

7. An apparatus for protecting a functional fluid used in a wellbore in which an environmental media resides, comprising:

a conveyance device configured to be disposed in the wellbore;

a well tool positioned along the conveyance device and exposed to the environmental media, the well tool including:

an outer pliant shell, an inner pliant shell disposed inside the outer pliant shell, wherein a sealed space separates the inner and outer pliant shells, and wherein the inner pliant shell defines a variable volume for receiving the functional fluid, at least one ring-shaped body disposed in the space and separating the inner and the outer pliant shell, and a filler filling the sealed space, wherein the filler includes at least one of: (i) a fluid pressurized to at least a value of a pressure external to the outer pliant shell, and (ii) a sorbent configured to store the environmental media; and a hydraulic source positioned along the conveyance device and configured to circulate the functional fluid into and out of the variable volume.

8. The apparatus of claim 7, wherein the variable volume includes a first volume and a second larger volume.

9. The apparatus of claim 7, wherein the hydraulic source is a device configured to use the functional fluid in the wellbore.

10. The apparatus of claim 9, wherein the wellbore device is selected from one of: (i) a drilling motor, (ii) an actuator, (iii) a hydraulic motor, (iii) a motor for operating a hole enlargement device.

11. A method for protecting a functional fluid used in a wellbore in which an environmental media resides, comprising:

forming an enclosure having an outer pliant shell, an inner pliant shell disposed inside the outer pliant shell, wherein a sealed space separates the inner and outer pliant shells, and wherein the inner pliant shell defines a variable volume;

at least partially filling the sealed space with a filler that includes a sorbent mixed with a liquid, the sorbent being configured to store a foreign fluid;

positioning the enclosure along a conveyance device conveyed into the wellbore;

at least partially filling the variable volume with the functional fluid;

circulating the functional fluid into and out of the variable volume using a hydraulic source while the enclosure is in the wellbore.

12. The method of claim 11, wherein the variable volume includes a first volume and a second larger volume.

13. The method of claim 11, further comprising pressurizing a fluid in the filler to at least a value of a pressure external to the outer pliant shell.

* * * * *